US009347748B1

(12) United States Patent
Crisp

(10) Patent No.: US 9,347,748 B1
(45) Date of Patent: May 24, 2016

(54) MOBILE BALLISTIC DEFENSE SHIELD WITH ENHANCED USER PROTECTION

(71) Applicant: Jeff Allen Crisp, Lyndon, KS (US)

(72) Inventor: Jeff Allen Crisp, Lyndon, KS (US)

( * ) Notice: Subject to any disclaimer, the term of this patent is extended or adjusted under 35 U.S.C. 154(b) by 0 days.

(21) Appl. No.: 14/617,846

(22) Filed: Feb. 9, 2015

Related U.S. Application Data

(60) Provisional application No. 61/937,939, filed on Feb. 10, 2014.

(51) Int. Cl.
*F41H 5/08* (2006.01)
*F41H 7/00* (2006.01)
*F41H 7/04* (2006.01)

(52) U.S. Cl.
CPC .. *F41H 5/08* (2013.01); *F41H 7/00* (2013.01); *F41H 7/042* (2013.01)

(58) Field of Classification Search
CPC ..... F41H 1/00; F41H 5/14; F41H 5/08; F41H 5/023
USPC ..... 89/36.07, 36.14, 36.13, 36.02, 36.01, 89/36.03, 36.04, 36.06, 36.17, 36.09; 428/911; 2/2.5; 109/49.5
See application file for complete search history.

(56) References Cited

U.S. PATENT DOCUMENTS 1,281,400 A * 10/1918 Larnell ..... F41H 5/14 109/49.5
1,304,541 A * 5/1919 Clark ..... F41H 5/14 109/22
2,209,654 A * 7/1940 Loeser, Jr. ..... F41H 5/08 109/49.5
6,907,811 B2 * 6/2005 White ..... F41H 5/14 109/49.5
7,302,880 B1 * 12/2007 Elasic ..... F41H 13/0087 89/36.01
7,594,515 B2 * 9/2009 Prock ..... F41H 5/08 135/115
7,934,444 B2 * 5/2011 Carberry ..... E04H 9/10 109/49.5
8,015,910 B1 * 9/2011 Fuqua ..... F41H 5/14 89/36.01
8,276,498 B1 10/2012 Hannibal et al.
2011/0011255 A1 * 1/2011 Kleniatis ..... F41H 5/08 89/36.09
2012/0174768 A1 * 7/2012 Spransy ..... F41H 5/013 89/36.09
2014/0238225 A1 8/2014 Mickiewicz
2015/0233679 A1 * 8/2015 Seabrook ..... F41H 5/08 89/36.07

* cited by examiner

*Primary Examiner* — Samir Abdosh
*Assistant Examiner* — John D Cooper
(74) *Attorney, Agent, or Firm* — Plager Schack LLP

(57) ABSTRACT

A mobile ballistic defense shield with enhanced protection for a user includes a base frame with swivel castors to contact a ground surface, a ballistic main plate with at least one shooting port and a viewing port, the ballistic main plate affixed to the base frame and oriented to enable the main plate to extend upward from the ground surface, a ballistic foot plate pivotably mounted to a bottom portion of the ballistic main plate, and a handle affixed to the ballistic foot plate and connected to a support assembly affixed to the base frame. The handle adjusts to a first position to enable the ballistic foot plate to contact the ground surface. The handle adjusts to a second position to enable the ballistic foot plate to pivot away from the ground surface, thereby permitting the base frame to travel along the ground surface.

8 Claims, 4 Drawing Sheets

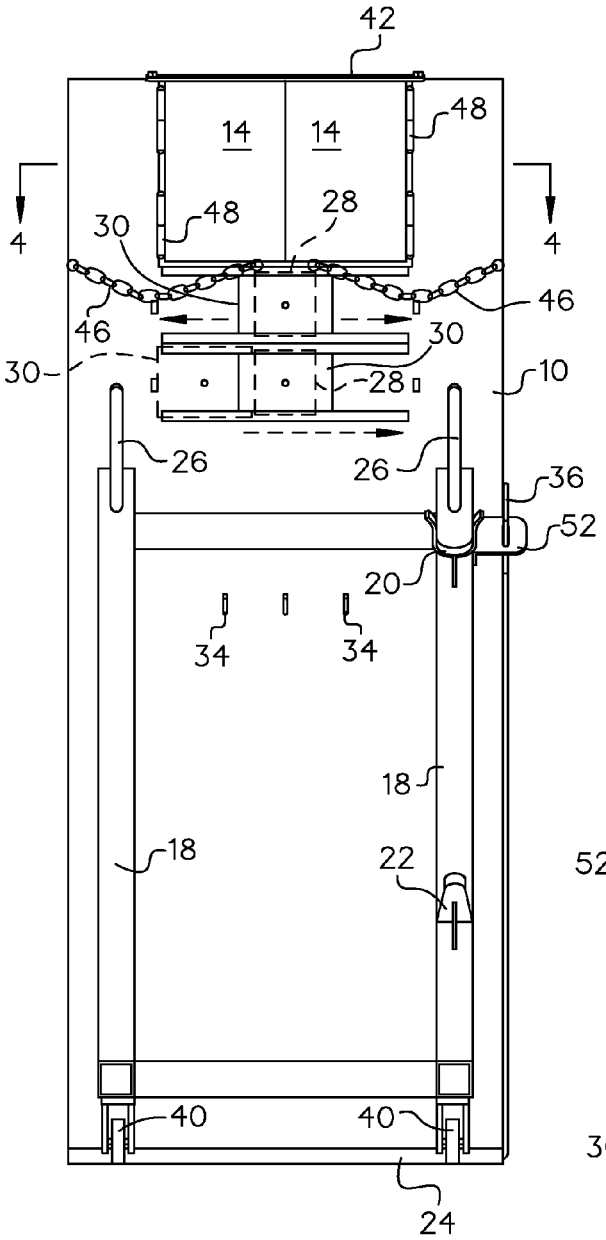
FIG.2
FIG.3
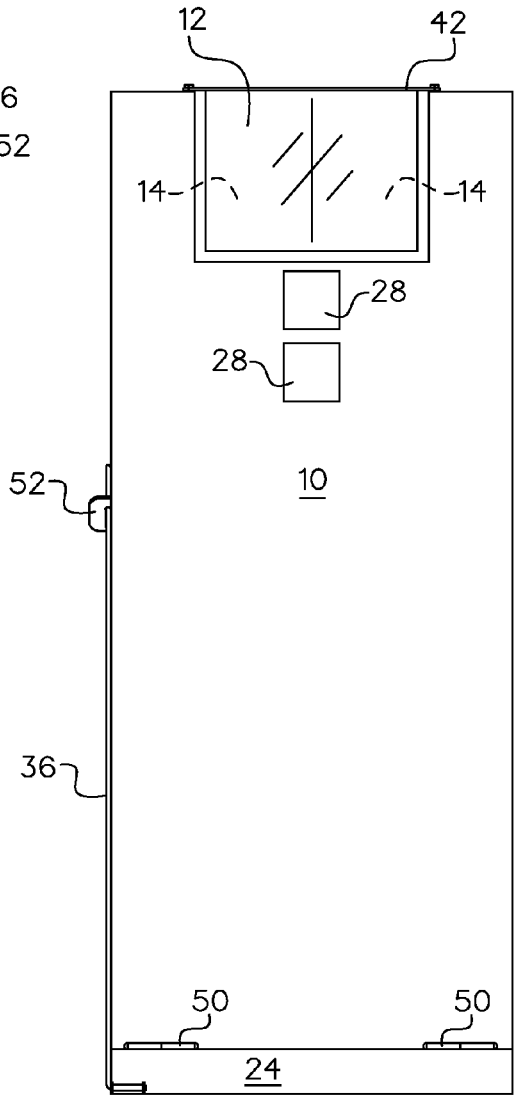

MOBILE BALLISTIC DEFENSE SHIELD WITH ENHANCED USER PROTECTION

RELATED APPLICATION

The application claims priority to provisional patent application U.S. Ser. No. 61/937,939 filed on Feb. 10, 2014, the entire contents of which is herein incorporated by reference.

BACKGROUND

The embodiments herein relate generally to ballistic defense shields used in a variety of applications by security, law enforcement or military personnel, or the like.

Ballistic shields are used by security, law enforcement and/or military personnel when responding to active shooters, intruders and/or aggressors. These ballistic shields protect the user by minimizing exposure of body parts to oncoming projectiles such as bullets, grenades, or the like. There exist a variety of ballistic defense shields such as those disclosed in U.S. Pat. No. 8,276,498 and U.S. Patent Application Publication 2014/0238225. However, these defense shields are assembled and/or transported by hand, and therefore do not comprise the strength and/or weight of materials necessary to provide protection from heavy firearms. Alternatively, there exist heavy duty defense shields mounted on all-terrain tires. However, these defense shields are disadvantageous because they expose the tires to oncoming projectiles and provide limited protection. This renders the user vulnerable to attacks. Specifically, oncoming projectiles can deflect off the ground and under the tire axle of the shield, thereby permitting one or more projectiles to strike the user behind the shield.

As such, there is a need in the industry for a mobile ballistic defense shield with enhanced user protection, which addresses the limitations of the prior art.

SUMMARY

A mobile ballistic defense shield with enhanced protection for a user is provided. The defense shield is configured to minimize exposure of the body of the user to oncoming projectiles. The defense shield comprises a base frame comprising a plurality of swivel castors configured to contact a ground surface, a ballistic main plate comprising at least one shooting port and a viewing port, the ballistic main plate affixed to the base frame and oriented to enable the main plate to extend upward from the ground surface, a ballistic foot plate pivotably mounted to a bottom portion of the ballistic main plate, and a handle affixed to the ballistic foot plate and operably connected to a support assembly affixed to the base frame, wherein the handle is configured to adjust to a first position to enable the ballistic foot plate to contact the ground surface, wherein the handle is configured to adjust to a second position to enable the ballistic foot plate to pivot away from the ground surface, thereby permitting the base frame to travel along the ground surface.

BRIEF DESCRIPTION OF THE FIGURES

The detailed description of some embodiments of the invention will be made below with reference to the accompanying figures, wherein the figures disclose one or more embodiments of the present invention.

FIG. 2 depicts a rear view of certain embodiments of the mobile ballistic defense shield;

FIG. 3 depicts a front view of certain embodiments of the mobile ballistic defense shield;

DETAILED DESCRIPTION OF CERTAIN EMBODIMENTS

Figure 1:
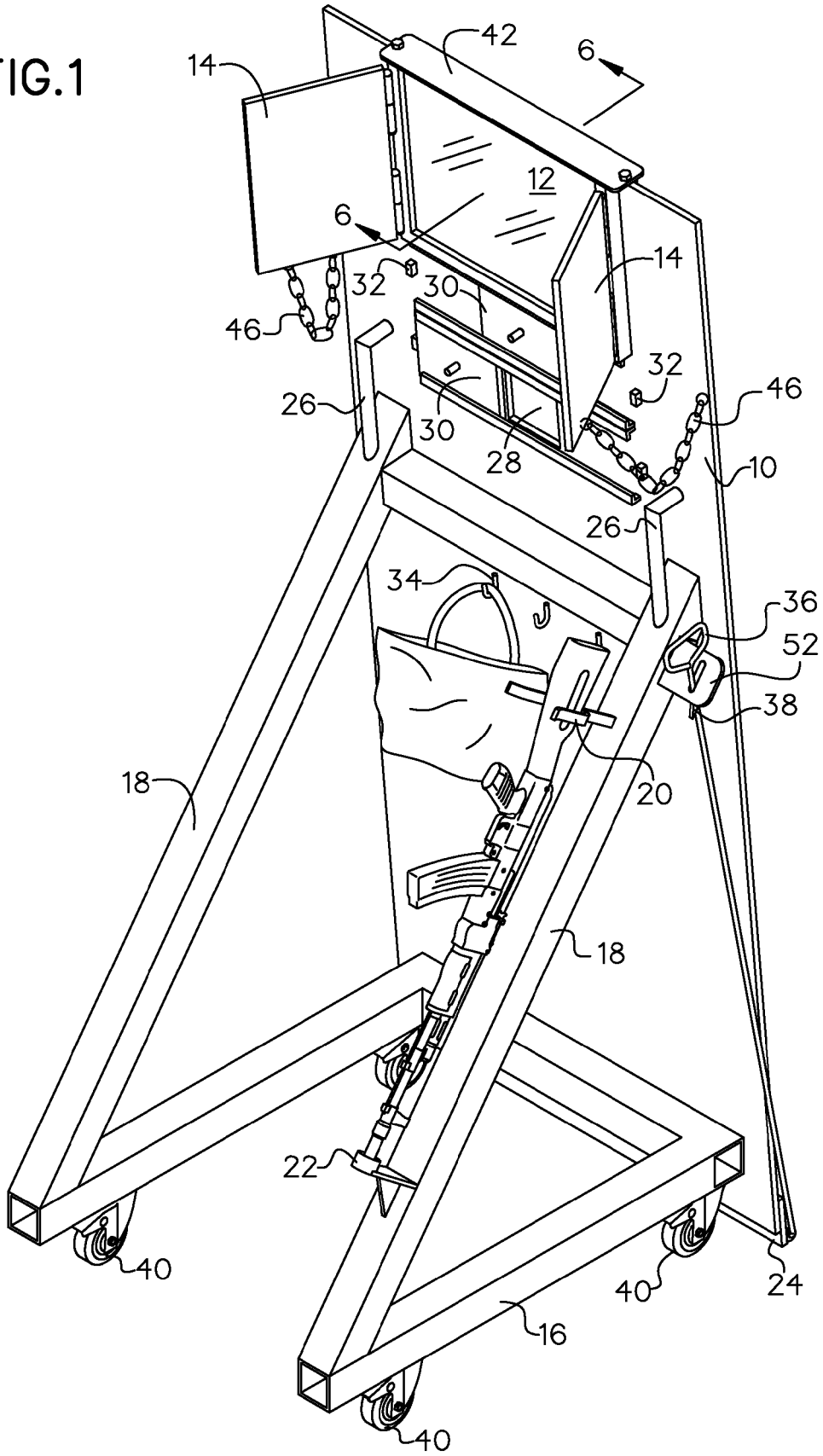
FIG. 1 depicts a perspective view of certain embodiments of the mobile ballistic defense shield shown in use.

As depicted in FIGS. 1-3, the mobile ballistic defense shield comprises base 16, support arms 18, shield 10 and foot plate 24. The defense shield enables a user (not shown) to stand or kneel in between support arms 18 and behind shield 10. Shield 10 blocks oncoming projectiles such as bullets, pellets, grenades or the like, from contacting any portion of the user's body.

Support arms 18 and base 16 serve as the frame for the defense shield and comprise 3"×3"×¼" steel tubular members secured together. The tubular members may be welded together or fastened using any components known in the field such as bolts, nuts, or the like. Castors 40 are secured to the bottom of base 16 and are configured to swivel to enable a user to easily transport the mobile ballistic defense shield over a ground surface. Although four castors 40 are depicted in the figures, it shall be appreciated that any alternative number of castors 40 may be used instead.

Shield 10 is a ballistic plate that is welded to base 16 and support arms 18 by weldment 44. This enables shield 10 to extend upward from the ground surface. In a preferred embodiment, shield 10 is made from 46100 ballistic steel and has approximate dimensions of 36"×74"×½". Shield 10 further comprises a pair of shooting ports 28 and a viewing port configured to receive glass plate 12. Shooting ports 28 can be partially covered or completely covered by shooting port doors 30, which are slidably mounted to shield 10 via track components. As depicted in FIG. 2, shooting port doors 30 may be slidably adjusted left or right as desired. In one embodiment, door stops are secured to shield 10 on the left and right sides of the track components to prevent shooting port doors 30 from detaching from the defense shield.

In a preferred embodiment, each shooting port 28 is a 6"×6" hole and each shooting port door 30 is a 8"×8"×½" 46100 ballistic steel plate. Although shooting port doors 30 are shown in the figures affixed to the rear face of shield 10, it shall be appreciated that shooting port doors 30 may be affixed to the front face of shield 10 instead. While the figures depict a pair of shooting ports 28 and corresponding shooting port doors 30, shield 10 may comprise any alternative number of shooting ports 28 and shooting port doors 30 instead.

Figure 4:
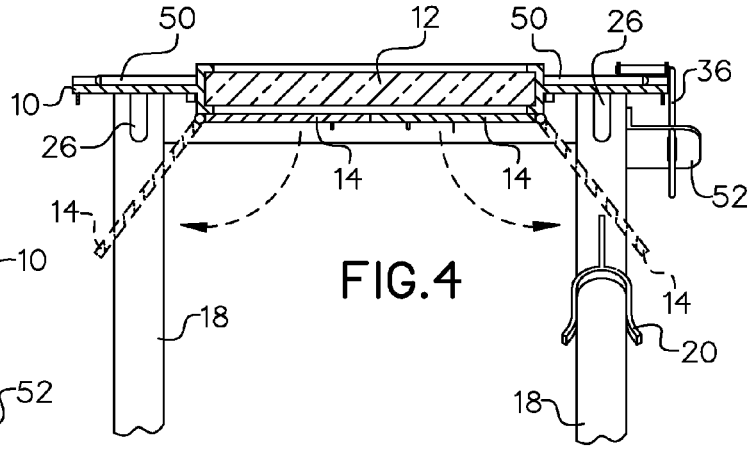
FIG. 4 depicts a section view of certain embodiments of the mobile ballistic defense shield taken along line 4-4 in FIG. 2 and omitting chains 46 for clarity.

Glass plate 12 is placed within the viewing port of shield 10 and secured in place by glass plate lock 42 and bolts. The bolts and glass plate lock 42 may be loosened and detached from shield 10 to enable the user to replace glass plate 12 if it becomes damaged and/or unusable. In a preferred embodiment, glass plate 12 is made from a transparent bullet resistant material such as acrylic polycarbonate and has approximate dimensions of 15"×20"×2". Doors 14 are pivotably mounted to shield 10 via door hinges 48 and chains 46. As depicted in FIG. 4, this enables a user to pivotably adjust doors 14 to partially cover or completely cover glass plate 12 if damaged and/or additional protection from oncoming projectiles is desired. Door stops 32 are affixed to shield 10 and are configured to catch doors 14 in their fully rotated position away from glass plate 12.

Figure 5:
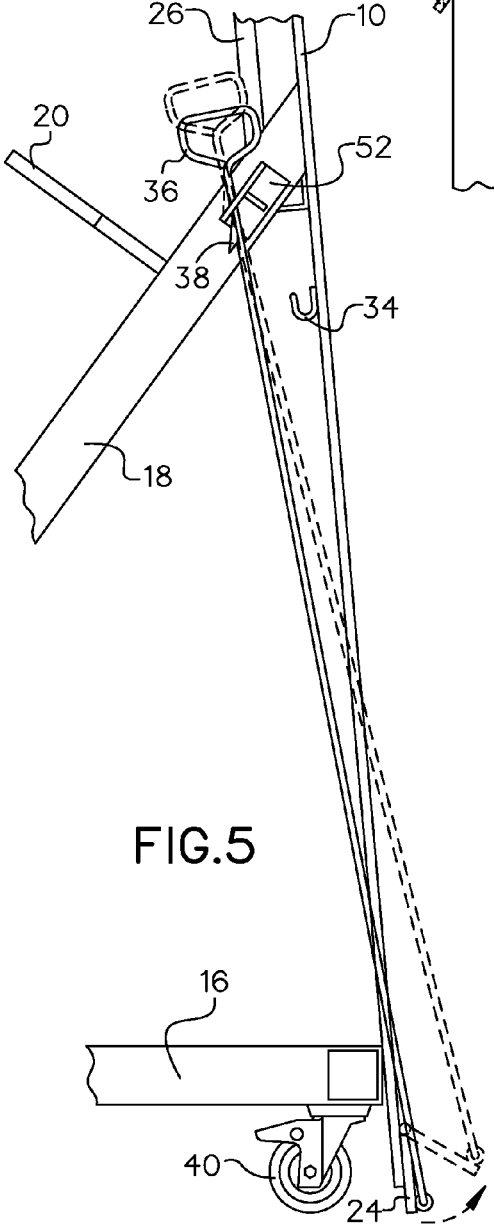
FIG. 5 depicts a side view of certain embodiments of the mobile ballistic defense shield.
Figure 7:
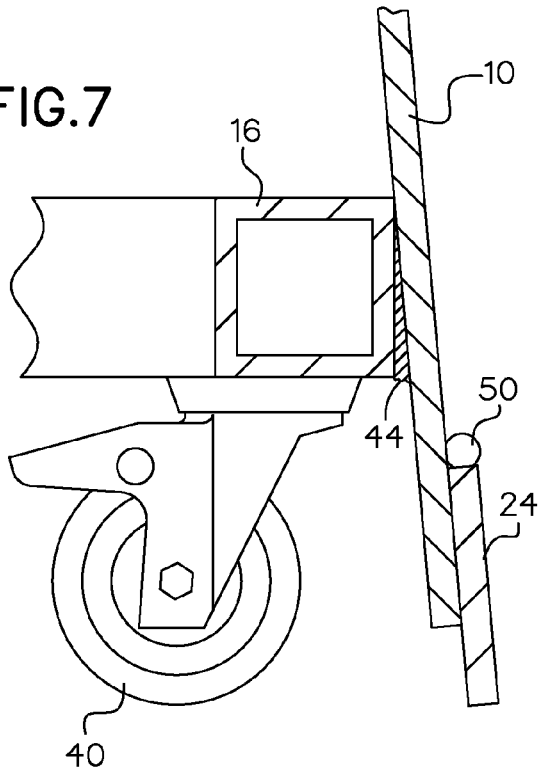
FIG. 7 depicts a section view of certain embodiments of the mobile ballistic defense shield.
Figure 6:
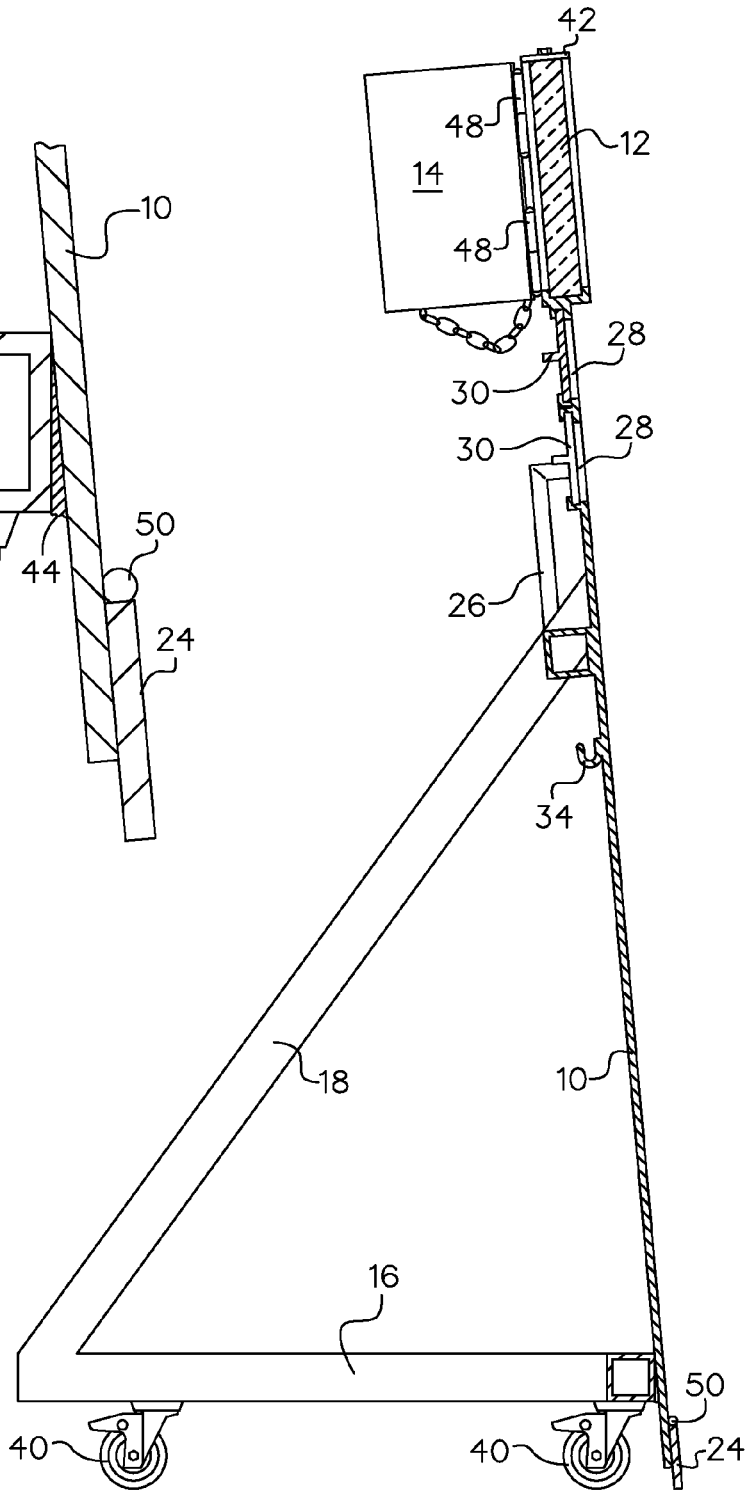
FIG. 6 depicts a section view of certain embodiments of the mobile ballistic defense shield taken along line 6-6 in FIG. 1.

Foot plate 24 is pivotably mounted to the bottom portion of shield 10 via foot plate hinges 50. Foot plate 24 is a ½" thick 46100 ballistic steel plate that is also operably connected to handle 36. Handle 36 is connected to a support assembly comprising handle support plate 52 and handle locking mechanism 38. More specifically, handle 36 is secured within a slot in handle support plate 52, which permits an adjustment of the handle. As depicted in FIG. 5, handle 36 may be adjusted to a first position to enable foot plate 24 to contact the ground surface. A user can apply an upward force to adjust handle 36 to a second position to enable foot plate 24 to pivot away from the ground surface. This allows the mobile ballistic defense shield to travel easily on the ground surface. In the second position, handle 36 is secured in place by handle locking mechanism 38. To release foot plate 24, the user pushes handle 36 forward, which adjusts handle 36 back to the first position. This allows foot plate 24 to drop down and contact the ground surface again. In this configuration, foot plate 24 enhances user protection by preventing bullets from deflecting off the ground and under shield 10, thereby minimizing the chance oncoming bullets will strike the user. FIGS. 6-7 depict additional section views of certain embodiments of the mobile ballistic defense shield.

In one embodiment of the invention, upper gun rack 20 and lower gun rack 22 are affixed to support arm 18. This enables a user to store a gun within upper gun rack 20 and lower gun rack 22. In one embodiment of the invention, a pair of grip handles 26 is affixed to shield 10 and support handles 18. This enables the user to grip handles 26 when transporting the mobile ballistic defense shield along the ground surface. In one embodiment of the invention, hooks 34 are affixed to shield 10. This enables the user to hang one or more bags on hooks 34 containing items such as ammunition packs, medical kits, tool kits, food, drink, and the like.

In operation, the user transports the mobile ballistic defense shield to a desired location. Handle 36 is adjusted to enable foot plate 24 to contact the ground surface. The user positions his/her body in between support arms 18 and behind shield 10. Doors 14 are pivotably adjusted as desired to enhance the user's field of vision to help identify shooters, intruders or aggressors. Either shooting port door 30 may be adjusted to create an opening in shooting port 28 sufficiently large to enable the user to maneuver and fire a gun through shooting port 28. Since the user is behind the mobile ballistic defense shield, he/she is protected from oncoming projectiles such as bullets, pellets or grenades by shield 10, glass plate 12, doors 14 and/or foot plate 24.

It shall be appreciated that the components of the mobile ballistic defense shield described in several embodiments herein may comprise any alternative known materials in the field and be of any color, size and/or dimensions. It shall be appreciated that the components of the mobile ballistic defense shield described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A mobile ballistic defense shield with enhanced protection for a user, the defense shield being configured to minimize exposure of the body of the user to oncoming projectiles, the defense shield comprising:

a base frame comprising an upper portion and a lower portion, the lower portion comprising a plurality of swivel castors affixed thereto and configured to contact a ground surface;

a ballistic main plate comprising at least one shooting port and a viewing port, the ballistic main plate affixed to the base frame and oriented to enable the main plate to extend upward from the ground surface, the ballistic main plate being positioned to create an opening between a bottom edge of the main plate and the ground surface;

a ballistic foot plate pivotably mounted to a bottom portion of the ballistic main plate; and a handle affixed to the ballistic foot plate and operably connected to a support assembly affixed to the upper portion of the base frame, the support assembly comprising a support plate comprising a slot configured to permit the handle to be disposed therethrough, wherein the handle is configured to adjust to a first position within the support plate slot to enable the ballistic foot plate to contact the ground surface to close the opening between the bottom edge of the ballistic main plate and ground surface, wherein the handle is configured to adjust to a second position within the support plate slot to enable the ballistic foot plate to pivot away from the ground surface to expose the opening between the bottom edge of the ballistic main plate and ground surface, thereby permitting the base frame to travel along the ground surface via the swivel castors.

2. The mobile ballistic defense shield of claim 1, further comprising a locking mechanism coupled to the handle and configured to contact the support plate of the support assembly to secure the handle in the second position.

3. The mobile ballistic defense shield of claim 2, further comprising a transparent ballistic plate detachably coupled to the viewing port of the ballistic main plate.

4. The mobile ballistic defense shield of claim 3, further comprising a shooting port door slidably mounted to the ballistic main plate, wherein the shooting port door is configured to slidably adjust to cover any portion of the at least one shooting port.

5. The mobile ballistic defense shield of claim 4, further comprising a first ballistic door pivotably mounted to a first edge of the viewing port and a second ballistic door pivotably mounted to a second edge of the viewing port.

6. The mobile ballistic defense shield of claim 5, further comprising a rack affixed to the base frame, wherein the rack is configured to store a gun.

7. The mobile ballistic defense shield of claim 6, further comprising a plurality of hooks affixed to the ballistic main plate.

8. The mobile ballistic defense shield of claim 7, further comprising a pair of grip handles affixed to both the ballistic main plate and the base frame.

* * * * *